US005372394A

United States Patent [19]

Salter et al.

[11] Patent Number: 5,372,394

[45] Date of Patent: Dec. 13, 1994

[54] PNEUMATIC CONTROLLED EXIT DEVICE

[75] Inventors: Kenneth E. Salter; Stephen C. Dean, both of Indianapolis, Ind.

[73] Assignee: Von Duprin, Inc., Indianapolis, Ind.

[21] Appl. No.: 70,066

[22] Filed: Jun. 1, 1993

[51] Int. Cl.[5] ..... E05B 65/10

[52] U.S. Cl. ..... 292/92; 292/144

[58] Field of Search ..... 292/21, 92, 153, 144, 292/201, 336.3, 150, 207, 229

[56] References Cited

U.S. PATENT DOCUMENTS

| | | | |
|---|---|---|---|
| 2,621,951 | 12/1952 | Ostadál | 292/153 X |
| 3,945,670 | 3/1976 | Peterson | 292/144 X |
| 4,167,280 | 9/1979 | Godec et al. | 292/92 |
| 4,169,616 | 10/1979 | Peterson | 292/144 |
| 5,035,450 | 7/1991 | Muller | 292/92 |
| 5,085,475 | 2/1992 | Austin et al. | 292/144 X |

*Primary Examiner*—Rodney M. Lindsey

*Attorney, Agent, or Firm*—Robert F. Palermo; A. James Richardson

[57] ABSTRACT

A pneumatically controlled exit device assembly for remote latching and unlatching of a door by controlling air pressure directed to the exit device from a pneumatic pressure source is described. The device includes a push bar operated exit device for retracting a latch of the emergency door, with the exit device having an air cylinder assembly biased to control retraction of the latch in response to changes in applied air pressure. In addition, a pneumatic transfer assembly is provided in fluid connection between the pneumatic pressure source and the air cylinder assembly, with the pneumatic transfer assembly having an air line and a mechanism for protecting the airline positioned between the door frame and the door.

13 Claims, 4 Drawing Sheets

PNEUMATIC CONTROLLED EXIT DEVICE

BACKGROUND OF THE INVENTION

The present invention relates to pneumatic control of exit device hardware and more particularly to pneumatic control of a door latch through use of a pneumatic piston coupled to an air source through protected air lines.

Limiting uncontrolled entrance or exit from a building or other contained space is often required for safety and security. However, in an emergency situation it is necessary to have a procedure for quickly and safely exiting the building or contained space. Conventionally, such exit procedures involve use of doors having easy operating push bars or pads for panic exits.

Such doors are commonly found in buildings where security personnel are not available to control egress. To allow for centralized control of door lock operation, it is known to automatically operate the door latch from a remote location. For example, when a fire alarm is triggered by building smoke detectors, a signal can be sent to lock the latch mechanism of all fire doors, while still allowing mechanical override to allow for emergency exit of building occupants. Those individuals already within the building can escape, while entrance into fire threatened areas is limited. Alternatively, security personnel can remotely control unlocking of particular doors as necessary to allow ingress.

Such remote controlled doors are conventionally operated by electrical connections between each door and one or more control stations. In use, a control station operator flips a switch to either unlock or lock the latch bolt holding the door latch of the door in a closed position. In one class of latch devices, a solenoid assembly is used to hold the latch bolt in a retracted position. Activation of the control switch, whether automatically in response to a fire alarm or by the control station operator, breaks the electrical connection with the solenoid, and allows extension of the latch bolt. Optionally, a sensor can be placed to indicate whether the door latch is extended. This type of device has a failsafe operation, with any break in the electrical connection between the control station and the door causing deenergization of the solenoid and extension of the door latch.

However, electrical door control mechanisms may be too costly or unsafe to use in many situations. For example, currently available automatic electrical door control systems require installation of a costly separate power supply to operate electrical solenoid. In addition, safety regulations often do not permit electrical devices having a potential for sparking and electrical ignition in areas containing volatiles or other combustibles. To overcome these problems, pneumatically controlled door latch mechanisms for controlling ingress are needed.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

Accordingly, the present invention provides for a pneumatically controlled exit device assembly for remote latching and unlatching of a door by controlling air pressure directed to the exit device from a pneumatic pressure source. Typically, the door is a conventional double or single door mounted with hinges to a door frame.

The exit device assembly includes a push bar operated exit device for retracting a latch of the door, with the exit device having an air cylinder assembly biased to control extension and retraction of the latch in response to changes in applied air pressure. A pneumatic transfer assembly is situated in fluid connection between the pneumatic pressure source and the air cylinder assembly, with the pneumatic transfer assembly having an air line and a mechanism for protecting the airline where it passes between the door frame and the door.

The foregoing and other aspects will become apparent from the following detailed description of the invention when considered in conjunction with the accompanying drawing figures.

DETAILED DESCRIPTION

Figure 1:
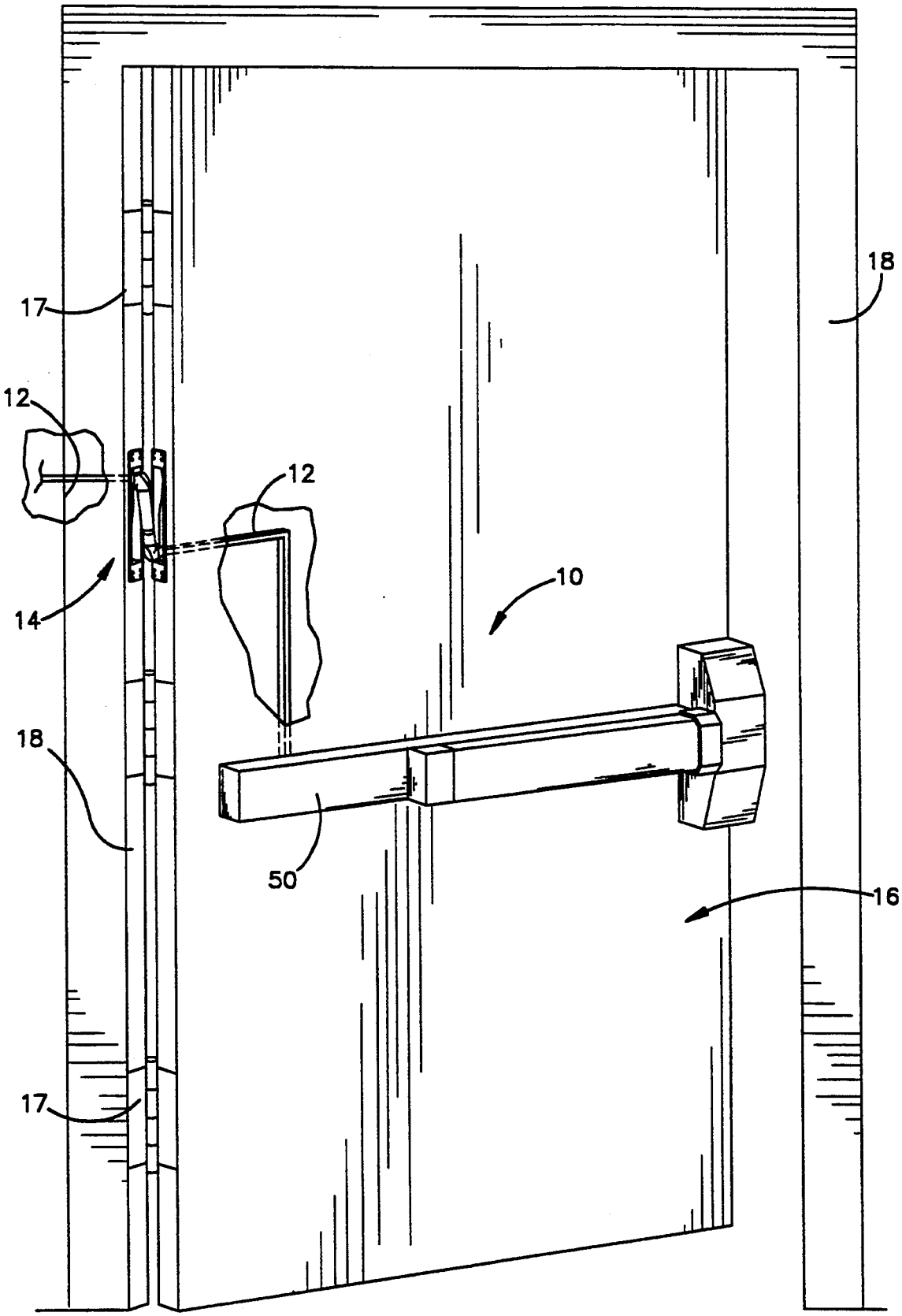
FIG. 1 is a perspective view of a hinged door equipped with a pneumatic exit device. The hinged door and door frame are partially broken away to better illustrate passage of an airline from a pneumatic pressure source (not shown) to the pneumatic exit device. The drawing further illustrates position of a pneumatic transfer assembly for protecting the airline as it passes from the door frame into the door.

As illustrated in FIG. 1, a pneumatic exit device 10 is attached to a door 16 to ensure controlled exit from sites that may include commercial buildings, schools, public facilities, or government buildings. Operation of the pneumatic exit device 10 is controlled by changes in air pressure applied to the device 10 through a pneumatic airline 12. The pneumatic exit device 10 is biased to maintain the door in a normally unlocked position when air pressure is continuously supplied. When air pressure is increased, the device 10 becomes locked.

The door 16 is of conventional construction, and is attached to a door frame 18 with hinges 17, allowing the door 16 to be swung outward for exit from a building. Typically, the door is a secure double or single door prominently marked as an emergency or fire exit.

Figure 3:
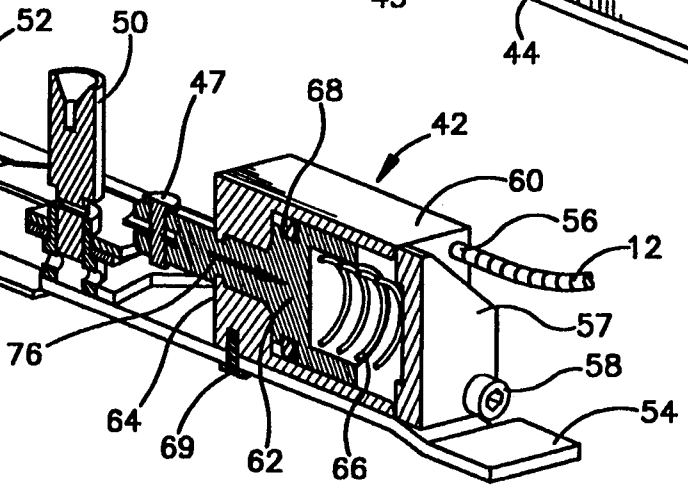
FIG. 3 is a cutaway view of the mechanism illustrated in FIG. 2, showing a biasing spring internally mounted in a cavity of the air cylinder assembly to resist the expansion of an air driven piston in the direction indicated by the arrow.
Figure 4:
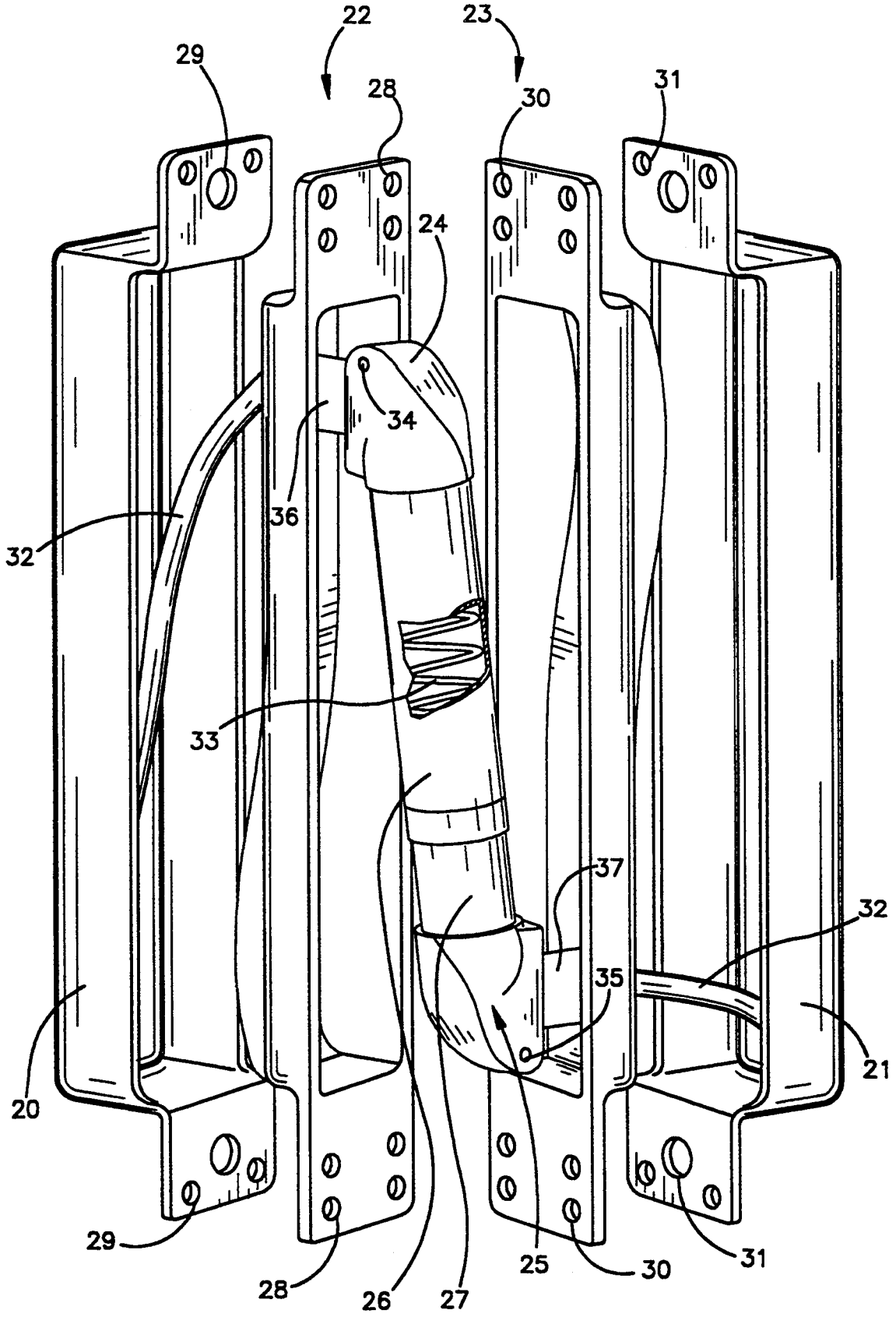
FIG. 4 is a detailed perspective view of the pneumatic transfer assembly that protects the airline and is schematically illustrated in FIG. 1. The drawing is partially broken away for a portion of a first slide tube to illustrate positioning of a coiled airline within the first slide tube.

The pneumatic airline 12 is connected to an exit device control assembly 40 as best shown in perspective view in FIG. 3, and in partially cutaway perspective view in FIG. 4. The exit device control assembly 40 can be used to open the door either manually in response to depression of a push bar attached by a push bar connection assembly 72, or automatically in response to air pressure changes to lock or unlock a latch mechanism (not shown) of the pneumatic exit device.

Manual operation relies on pivoting action of the push bar connection assembly 72 to move a latch actuating linkage longitudinally in the direction indicated by arrow 74. In operation, an operator would simply push a push pad, and ultimately cause retraction of a door latch following movement of the actuating linkage 46. Automatic control by application of pneumatic pressure similarly acts by inducing movement of the actuating linkage 46. However, instead of manual application of force, the exit device control assembly 40 is utilized to convert air pressure changes into a force sufficient to longitudinally move the actuating linkage. As will be appreciated by those skilled in the art, the exit device control assembly can be added to existing door latch mechanisms, and does not require the presence of a manual door opening option for proper operation.

Figure 2:
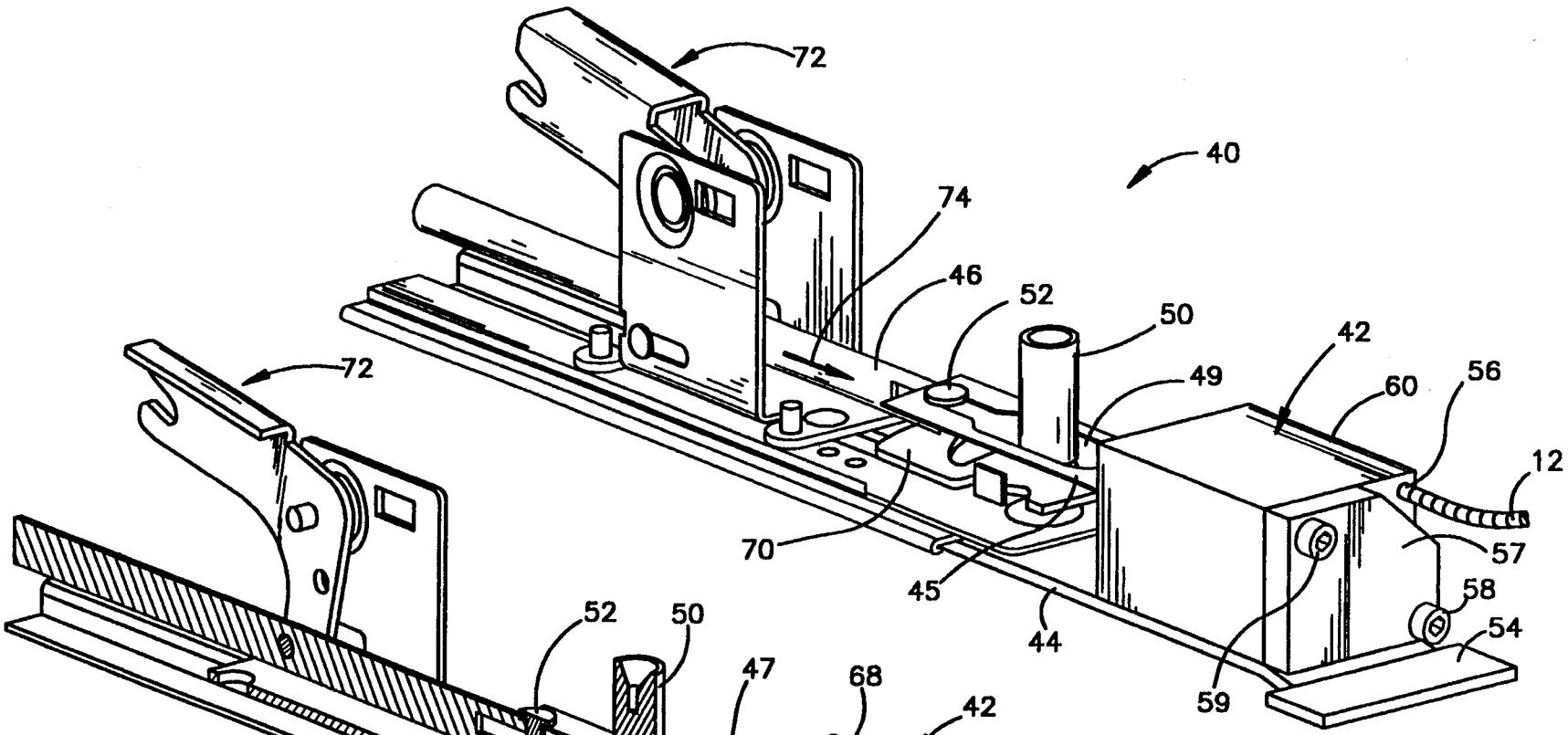
FIG. 2 is a perspective view of an exit device control assembly suitable for fitting into the pneumatic exit device of FIG. 1, with the air cylinder assembly illustrating positive action in the direction indicated by the arrow to pull the actuating linkage for the latch mechanism into a latch open position.

The exit device control assembly 40 shown in FIGS. 2 and 3 includes an air cylinder assembly 42 connected to the pneumatic airline 12, and an actuating linkage 46 connected to the latch mechanism. The air cylinder assembly 42 is also shown in exploded perspective view in FIG. 5. An air cylinder linkage 48 connects the air cylinder assembly 42 to the actuating linkage 46, with the linkage 48 passing around a mechanical dogging assembly 50 that can be key operated to move a dog arm catch 70 to inactivate the latch mechanism. Advantageously, the housing 60, piston 62, and air cylinder linkage 48 can be configured to fit into existing door exit assemblies for attachment to an actuating linkage 46, allowing simple retrofit conversion of manual latch mechanisms to dual manual/automatic controlled latch mechanisms.

Figure 5:
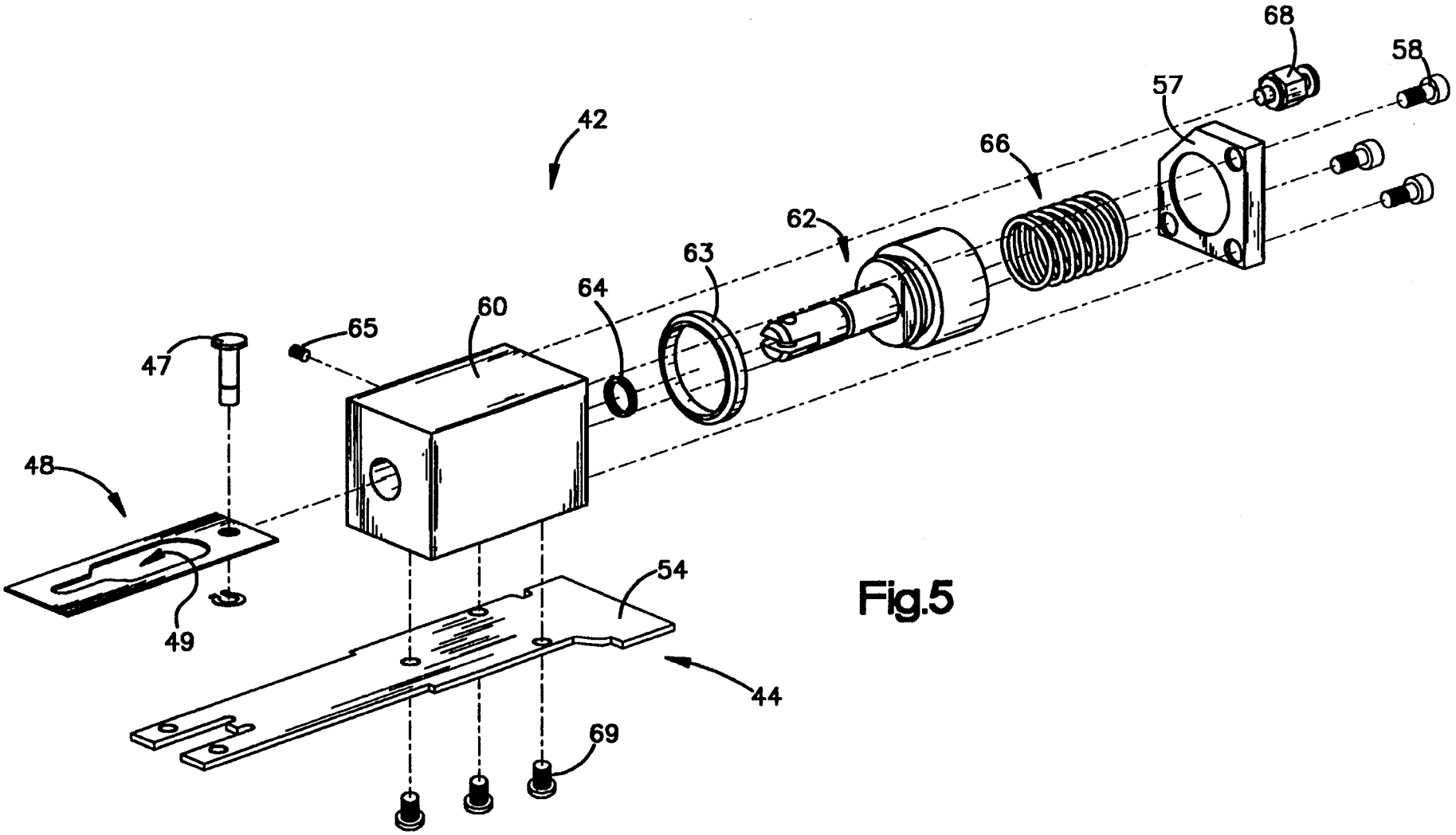
FIG. 5 is an exploded perspective view of the air cylinder assembly.

The air cylinder assembly 42 includes a housing 60 connected by pins 69 to a mounting bracket 44 having a back offset tab 54. The back offset tab 54 is dimensioned to permit a keyed fit of the assembly 40 into the pneumatic exit device 10 shown in FIG. 1. The housing 60 is hollow, and is configured to define a housing cavity 61 that accommodates sliding movement of a piston 62. The housing cavity 61 is sealed from atmospheric pressure by an O-ring seal 64 and ring seal 63 positioned to surround the piston at one end of the housing 60, and a plate 57 attached with attachment nuts 58 at the other end of the housing 60. An air pressure set screw 65 in fluid communication with the housing interior provides supplemental control of air pressure. A spring 66 is positioned in the housing cavity 61 between the piston 62 and the plate 57, as best seen in FIG. 3 and FIG. 5. Primary air communication is provided through connection to airline 12, which connects to a passage defined to pass through the housing 60 and open through air port 68 into the housing cavity 61.

The piston 62 is connected by a pin connector 47 to the air cylinder linkage 48. The air cylinder linkage 48 is a generally flat plate having a channel 49 defined through its center. The channel 49 allows the air cylinder linkage to be fitted around the mechanical dogging assembly 50, while still permitting longitudinal movement of the air cylinder linkage in response to longitudinal movement of the piston 62.

Opposite its end connected to the piston 62, the air cylinder linkage 48 is selectively connected to the actuating linkage 46 by a headed pin 52. Because of its position in the channel 49, the headed pin 52 remains unmoved when the air cylinder linkage 48 is advanced toward the actuating linkage 46. However, when the air cylinder linkage 48 moves away from the actuating linkage 46, the headed pin 52 will engage with the periphery of the air cylinder linkage 48, and be moved as the piston moves (along with the connected actuating linkage) toward the air cylinder assembly 42.

For pneumatic operation to be effective, the mechanical dogging assembly 50 must not be engaged so that its dog arm catch 70 hooks around to engage the headed pin 52. When the headed pin 52 is engaged by the catch 70, movement of the actuating linkage 46 is prevented, and the latch mechanism is effectively held back in an unlocked position. Only when the dogging assembly is not engaged is pneumatic operation feasible.

FIGS. 2 and 3 show the actuating linkage beginning to move in the direction indicated by arrow 74. In this position, the latch mechanism is normally locked, and an increase in pneumatic air pressure is required to move the actuating linkage and unlatch the door. In operation, an operator or automatic system determines the need to unlatch normally latched doors. Air pressure is increased in air lines to about 20 to about 100 pounds per square inch over a time period of about 0.5 to about 1.5 seconds. This air passes through airline 12, through a passage bored in the housing 60 of the exit device control assembly 40, and into the housing cavity 61 by way of air port 68. As air fills the housing cavity 61, movement of the piston 62 is promoted, with the air pressure exerting a greater force than the counter directed force of compression spring 66 fitted in the cavity.

Movement of the piston 66 in the direction of arrow 76 cause movement of the attached air cylinder linkage 48 in the same direction. Movement of the air cylinder linkage 48 in turn causes movement of the actuating linkage 46 in the same direction as the headed pin 52 attached to the actuating linkage 46 is pulled by the air cylinder linkage. Movement of the actuating linkage then cause retraction of a latch mechanism to permit opening of the door.

When air pressure is reduced sufficiently to decrease the force on the piston 62 below the force exerted by the spring 66, the piston and air cylinder linkage move outward, decoupling from the headed pin 42. The actuating linkage can then move opposite the direction indicated by arrow 74 to permit extension of a latch mechanism and relocking of the door.

As will be appreciated by those skilled in the art, components of the pneumatic exit device can be reversed or otherwise configured and attached to normally keep the latch in an closed position absent application of sufficient air pressure. For example, movement of the piston can be reversed or biased in a preferred direction by connection with a resilient element such as a tension spring (rather than a compression spring) positioned within the cavity defined by the housing. Mounting the air cylinder for normal latch unlocking bias may be desired for some applications, while mounting the air cylinder to permit normal latch locked bias is failsafe, with pressure drops caused by damage to airlines causing extension of the latch.

Proper operation of the pneumatic exit device 10 also requires employment of the pneumatic transfer assembly 14 to protect airline 12 as it passes from the door frame 18 to the door 16. In accordance with the present invention, the pneumatic transfer assembly 14 is seen in FIG. 1 and detailed in FIG. 4. The assembly 14 includes a first backbox 20 and a second backbox 21 respectively attached to door frame 18 and door 16 to respectively accept attached housing 22 and 23. The housings 22 and 23 are attached to the backboxes 20 and 21 through attachment holes 28, 29, 30, and 31. When properly attached, the first backbox 20 and its attached housing 22 are permanently fixed to the door frame 18. In addition, the second backbox 21 and attached housing 23 are fixedly attached to the door 16, but move relative to the door frame 18 as the door 16 is opened or closed.

Accommodating relative movement of the door and the door frame is enabled by use of hinge assemblies 24 and 25 respectively attached to the housings 22 and 23, The hinge assemblies are configured for two way rotational movement. Attached to the hinges assemblies 22 and 23 are slide tubes 26 and 27, with slide tube 27 partially fitting within slide tube 26 to allow sliding movement. As best shown in FIG. 4, a pneumatic airline 32 (coupled in fluid communication between airline 12 and a pneumatic air source) passes through the housings 20, 21 and through the slidingly interconnected slide tubes 26 and 27. In addition, the airline 32 is coiled (shown in breakaway portion of slide tubes in FIG. 4 and indicated by reference numeral 33) to allow stretching and contraction as the distance over which the airline passes increases or decreases in response to door movement.

Construction of the pneumatic transfer assembly in this manner permits protection of the airline from damage, and allows the use of 5/32 inch diameter air tubes to provide sufficient air pressure to the pneumatic exit device. In addition, construction and maintenance of the pneumatic transfer assembly do not require removal of an existing door from its hinges.

Although the invention has been described in detail with reference to the illustrated embodiment, variations and modifications exist within the scope and spirit of invention as described and as defined in the following claims.

What is claimed is:

1. A pneumatically controlled exit device assembly for remote latching and unlatching of a door by controlling air pressure directed to the exit device through an airline from a pneumatic pressure source, the door being mounted with hinges to a door frame, the assembly comprising:

a push bar operated exit device for retracting a latch of the door, said exit device having an air cylinder assembly having a housing formed to define a cavity therein and a piston movable in the cavity in response to applied air pressure, with said piston being coupled to an actuating linkage, with movement of the piston in response to changes in applied air pressure controlling movement of the latch through its connection by the actuating linkage; and a resilient element coupled between the housing and the piston to bias the piston for movement in a first direction.

2. The assembly of claim 1, further comprising a pneumatic transfer assembly in pneumatic connection between the pneumatic pressure source and the air cylinder assembly, with the pneumatic transfer assembly having a first housing attached to the door frame, a second housing attached to the door, a first slide tube pivotally attached to the first housing, and second slide tube pivotally attached to the second housing and configured for sliding interaction with the first slide tube, the first and second slide tubes being configured to accommodate passage of said airline therethrough.

3. The assembly of claim 2, wherein the first slide tube is rotatably connected to the housing by a first rotatable element rotatably connected to the first housing and a first hinge connected between the first rotatable element and the first slide tube, and the second slide tube is rotatably connected to the housing by a second rotatable element rotatably connected to the second housing and a second hinge connected between the second rotatable element and the second slide tube.

4. The assembly of claim 1, wherein the airline is coiled to permit expansion and contraction of the airline as the door is respectively opened and closed.

5. The assembly of claim 1, further comprising a mechanical dogging assembly for holding the latch in a retracted position.

6. The assembly of claim 5, wherein the mechanical dogging assembly is positioned between said piston and the actuating linkage, with said air cylinder linkage including a movable plate defining a channel therethrough to accommodate the mechanical dogging assembly.

7. The assembly of claim 1 further comprising means for retracting the latch in response to an increase in air pressure supplied to the air cylinder assembly.

8. The assembly of claim 1 further comprising means for retracting the latch in response to a decrease in air pressure supplied to the air cylinder assembly.

9. A pneumatically controlled exit device assembly for remote latching and unlatching of a door by controlling air pressure directed to the exit device from a pneumatic pressure source, the assembly comprising:

a housing attached to the door;

a latch mechanism for moving a latch configured to engage a door frame and hold the door fixed against movement;

an air cylinder assembly having means for moving a piston in response to changes in applied air pressure, with said moving means having a housing formed to define a cavity therein, wherein a spring is positioned in the cavity, and with said piston movable in the cavity in response to applied air pressure and action of the spring, the piston being coupled by an air cylinder linkage to an actuating linkage that retracts the latch of the door in response to changes in applied air pressure; and a pneumatic transfer assembly in fluid connection between the pneumatic pressure source and the air cylinder assembly, the pneumatic transfer assembly having an airline and means for protecting the airline positioned between the door frame and the door.

10. The assembly of claim 9, further comprising a mechanical dogging assembly for holding the latch in a retracted position.

11. The assembly of claim 10, wherein the mechanical dogging assembly is positioned between piston and the actuating linkage, with said air cylinder linkage including a movable plate defining a channel therethrough to accommodate the mechanical dogging assembly.

12. The assembly of claim 9, wherein the means for protecting the airline further comprises a first housing attached to the door frame, a second housing attached to the door, a first slide tube pivotally attached to the first housing, and second slide tube pivotally attached to the second housing and configured for sliding interaction with the first slide tube, the first and second slide tubes be configured to accommodate passage of said airline therethrough.

13. The assembly of claim 12, wherein the first slide tube is rotatably connected to the housing by a first rotatable element rotatably connected to the first housing and a first hinge connected between the first rotatable element and the first slide tube, and the second slide tube is rotatably connected to the housing by a second rotatable element rotatably connected to the second housing and a second hinge connected between the second rotatable element and the second slide tube.

* * * * *